United States Patent [19]

Murphy

[11] Patent Number: 4,758,002

[45] Date of Patent: Jul. 19, 1988

[54] INDOOR BASEBALL

[76] Inventor: Patrick M. Murphy, 27 Rosella Crescent, Wulagi, Darwin, Northern Territory, Australia

[21] Appl. No.: 51,343

[22] Filed: May 19, 1987

[30] Foreign Application Priority Data

May 19, 1986 [AU] Australia ..... PH5966

[51] Int. Cl.[4] ..... A63B 71/02

[52] U.S. Cl. ..... 273/411; 273/25; 272/3

[58] Field of Search ..... 273/26 A, 29 R, 410, 273/411, 88, 89, 90, 91, 25; 272/3

[56] References Cited

U.S. PATENT DOCUMENTS

| | | | |
|---|---|---|---|
| 856,216 | 1/1907 | Black | 273/90 |
| 1,053,568 | 2/1913 | Burch et al. | 273/89 |
| 1,634,296 | 7/1927 | Mattern et al. | 273/89 |
| 1,642,093 | 9/1927 | Stewart | 273/90 |
| 1,911,569 | 5/1933 | Hinckley | 273/25 |
| 1,933,159 | 10/1933 | Butler | 273/411 |
| 2,064,029 | 12/1936 | Miner | 273/89 |
| 2,276,457 | 3/1942 | Bock | 273/89 |
| 2,344,193 | 3/1944 | Woodard | 273/90 |
| 2,802,667 | 8/1957 | Bertley | 273/89 |
| 2,964,321 | 12/1960 | Anderson | 273/411 |
| 3,593,997 | 7/1971 | Boehner | 273/26 |
| 3,830,497 | 8/1974 | Peterson | 273/89 |
| 3,854,720 | 12/1974 | Duvall | 273/89 |
| 3,994,497 | 11/1976 | Cordingley | 273/411 |

FOREIGN PATENT DOCUMENTS

| | | |
|---|---|---|
| 7146281 | 12/1981 | Australia . |
| 85/03009 | 7/1985 | World Int. Prop. O. . |

*Primary Examiner*—Richard C. Pinkham
*Assistant Examiner*—T. Brown
*Attorney, Agent, or Firm*—Robert J. Koch

[57] ABSTRACT

An indoor baseball game includes apparatus comprising a rectangular enclosure having netting walls and roof, a playing surface of synthetic grass or the like within the enclosure has a minature baseball diamond marked thereon and a bonus "home run" area is defined on the wall of the enclosure behind second base, a "running line" is marked on the diamond 11.5 meters past home, first and second bases, and must be reached by a runner to avoid being "out", before the baseman on the proceeding base contacts the base with the ball in hand. Various parts of the walls of the enclosure are defined as providing bonus bases when the batter hits the ball so as to contact such parts. Bonus bases are in addition to those achieved by running and to which safe passage is ensured. A complete set of rules for playing the game are set forth.

7 Claims, 2 Drawing Sheets

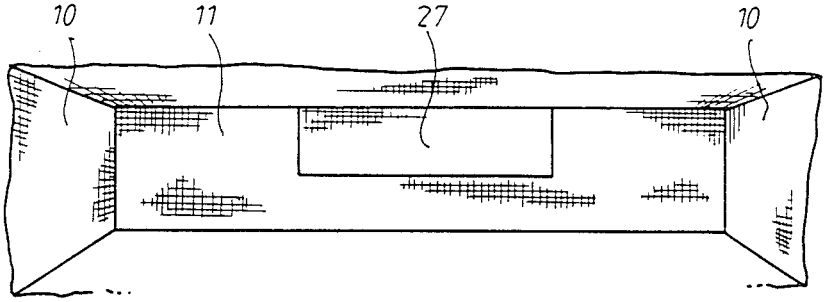
FIG. 2.
FIG. 3.
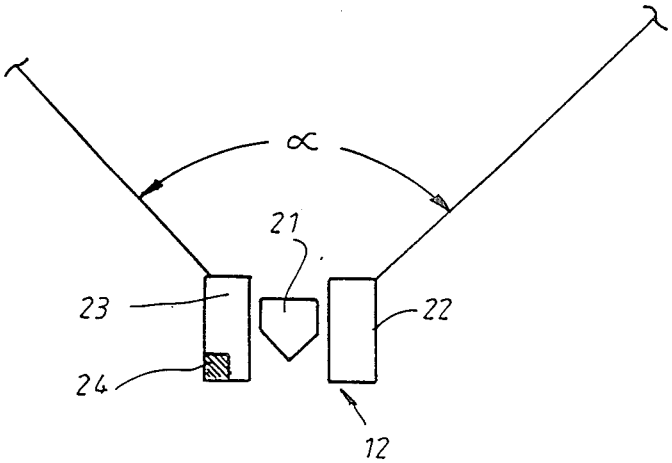

INDOOR BASEBALL

The present invention relates to an indoor sporting game and more particularly to an indoor baseball game. Baseball is a well known ball game that is played according to well established rules. It is desirable that baseball is played indoors such that the vagaries of the weather do not intervene.

It is known to play the conventional baseball game indoors but the required stadium is extremely large and thus prohibits localized competitions being played indoors, and for that matter, at least in Australia, prevents any form of indoor competition even at a national level. Some forms of an indoor baseball game are known but these have little if any resemblance to the real game and therefore do not serve to provide practice in the skills of the game. One example of an indoor game is disclosed in U.S. Pat. No. 3,830,497 by Richard Peterson which discloses a mini-baseball game intended for playing in the home using a miniature bat and a pitching device. The game disclosed in the Peterson specification is more of a game than one which would serve to improve the skills of someone wishing to play the proper outdoor game.

U.S. Pat. No. 3,593,997 by Douglas L. Boehner discloses a sport practice cage which is suitable for baseball batting practice but it does not facilitate playing of a baseball game within the cage.

Accordingly it is the object of this invention to provide an indoor baseball apparatus for enabling baseball to be played in a way which, at least in some respects, resembles the conventional outdoor game insofar as the skills required.

It is a further object to provide a baseball game suitable for playing within an indoor baseball apparatus.

The invention thus provides an indoor baseball apparatus comprising a playing enclosure including a playing surface surrounded by perimeter walls, a roof overlying said walls, said walls being transparent to the extent enabling a game played within said enclosure to be viewed from outside said enclosure, a miniature baseball diamond on said playing surface and including a defined base at each apex of said diamond, a short line called a running line marked on said surface at a point between each of said bases except between third base and home base, each said running line traversing the line of said diamond and being a substantial distance towards the proceeding base in the direction of a runner, a defined "home run" zone on a said wall of said enclosure, which wall is behind second base when viewed from home base, and alternate pitching plates on said surface within said diamond and in alignment between home base and second base at respective distances from home base.

The invention also provides a baseball game for playing with the above described apparatus and played substantially in accordance with the rules set forth herein.

In order that the invention may be more readily understood one particular embodiment will now be described with reference to the accompanying drawings wherein, FIG. 1 is a schematic plan view of an indoor baseball apparatus according to the invention;

FIG. 2 is a side elevation of an end wall of the apparatus shown in FIG. 1 and

FIG. 3 is an enlarged schematic plan view of the home base of FIG. 1.

Figure 1:
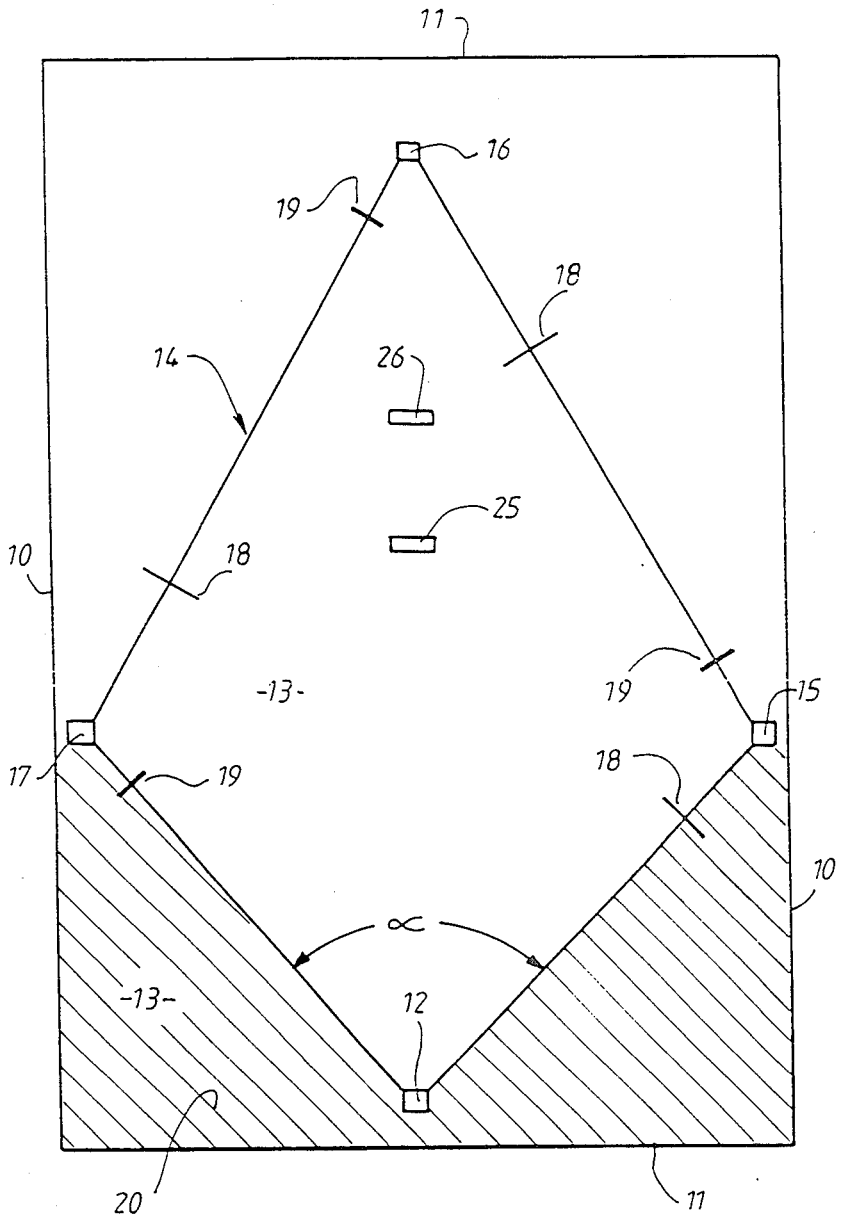

The apparatus comprises a rectangular playing enclosure defined by opposed side walls 10 and apposed end walls 11 which are not shown in any detail in the drawings. The walls are formed of netting which is held taut by suitable stays or the like (not shown). A netting roof (not shown) extends between the tops of the walls to cover the top of the enclosure. The use of taut netting means that the enclosure is transparent to the extend that a baseball game being played therein may be viewed by spectators located externally of the enclosure. A netting doorway (not shown) in one of the walls allows access and is closed during playing of a game. The doorway is preferably in an end wall 11 and adjacent to the home base 12 of the baseball diamond.

The playing surface 13 on the floor of the enclosure is synthetic grass but may be carpet or other suitable material. According to this embodiment the side walls 10 are 30 meters in length and 4.5 meters high and the end walls 11 are 24 meters long and 4.5 meters high. These dimensions are not critical and variations in the range 20–24 meters for the width and 28–30 meters for the length can be readily tolerated.

The playing surface 13 is marked with a diamond 14 similar to a conventional baseball diamond but considerably smaller in size. The dimensions of the diamond 14 are also not critical and will depend more on the dimensions of the enclosure since the home base 12 is arranged three meters from the adjacent end wall 11 and first base 15 and third base 17 are each arranged two meters from the respective side walls 10. The side of the diamond 14 joining home base 12 and first base 15 and the side joining home base 12 and third base 17 enclose an angle $\alpha$ which is 90°. The second base 16 is arranged to be four meters from the adjacent end wall 11 on an imaginary line between home and second base which is normal to an imaginary line joining first and third bases. A short line 18 is marked on the surface to traverse the line joining home base 12 and first base 15 and is eleven and one half (11.5) meters from home base 12. A similar short line 18 is provided between first and second base and well as between second and third bases and in each case is 11.5 meters from the preceding base. The short lines 18 are called a "running line" and are 1.5 meters in length. A runner between bases must make good the running line 18 before the ball is taken by a baseman making contact with proceeding base. A line similar to a running line 18 is arranged proceeding first, second and third bases in the direction of a runner and is called a "no return line" 19. The no return line 19 is arranged at a distance of 2 meters from the preceding base and once a runner passes this line he cannot return to the preceding base.

The shaded area 20 shown in FIG. 1 indicates an area of the playing surface designated foul territory. The area within the diamond is called the infield and the remaining area (non-shaded) outside the diamond is termed the outfield. The infield and outfield are termed fair territory.

The first, second and third bases are marked on the playing surface 13 using square canvas bags having 375 mm long sides. The home base 12 consists of a home plate 21, two batters boxes 22 and 23 respectively and a safety plate 24 which is included within the batters box 23. The home plate 21 is formed as a square having 425 mm sides with two adjacent corners being cut off to provide a pentagon as shown wherein the sides formed by the cut off corners are aligned respectively with the sides of the diamond 14 which terminate at home base 12.

The safety plate 24 is of the same dimensions as the plate forming first, second and third bases.

A pitching plate 25 called an "underarm" pitching plate is arranged fourteen (14) meters from the home plate 21 on the imaginary line joining home base 12 and second base 16. A further pitching plate 26 called an "overarm" pitching plate is arranged 17 meters from the home plate 21 on the same line as the underarm pitching plate 25.

The end wall 11 adjacent second base 16 is provided with markings which define a "home run" area 27 which if hit by a ball from the batter's bat, entitles the batter to a free home run, as will become apparent hereinbelow. The markings defining the home run area 27 are evident in FIG. 2. The remainder of the end wall 11 which has the home run area 27 thereon, including the space under the area 27, is a bonus two area in the sense that a batter hitting the ball into the end wall 11, other than into the home run area 27, is allowed two free bases above, those which have been reached by running (subject to the proviso of rule (11)(d) hereinbelow). The home run area is 10 meters wide and 2 meters above the playing surface 13. The entire area of the outfield area, that is, between a point adjacent first base on one side and third base on the other, and the intersection with the end wall 11 which is adjacent second base, provides a bonus one area in the sense that a batter hitting the ball into this area is allowed one free base above those which have been reached by running subject again to the rules hereinbelow. The bonus one area may be defined by a vertical line (not shown) on the side walls 10 adjacent first and third bases respectively.

Having described the apparatus the rules for playing a game, according to one particular embodiment, will now be set forth hereinbelow. Some of the rules relate to a league of teams playing in a competition and may not be particularly relevant hereto but are included for completeness.

INDEX

1. Equipment
2. Team Numbers
3. Officials
4. Duration
5. Rules of Playing
   (i) Starting and Re-commencing Play
   (ii) Live and Dead Bal
   (iii) Fielding
   (iv) Pitching
   (v) No-Pitch
   (vi) Illegal Pitch
   (vii) Wild Pitch
   (viii) Batting
   (ix) Strike
   (x) Ball
   (xi) Bonus Bases
   (xii) Batter-Runner
   (xiii) Batter Put Out
   (xiv) Running
   (xv) Stealing
   (xvi) Runner Put Out
   (xvii) Team Scoring
   (xviii) Misconduct Rule
6. League Scoring System
7. Qualifications
8. Mixed, Junior and Women
9. Court Layout and Dimensions

1. EQUIPMENT (a) The bat is of regulation Baseball dimensions. The ball is moulded rubber, encasing a kapok or other approved core such that is lighter and far less dangerous than a normal softball. It is 11 inches in circumference.

(b) Dress Regulations. All players must wear matching tops with a clearly visible number at least 3 inches high on the front. Track shoes or runners must be worn. There is a bonus one (1) point if all players on the team are in uniform.

(c) The catcher must wear a leather mit and a face mask. Mits are optional for all other players.

(d) When batting a player must wear a protective helmet.

2. TEAM NUMBERS (a) A team consists of eight (8) players. Substitutes are only allowed for a player who is injured during the course of the game and is unable to take further part. The substitute shall bat in the position and in the order of the injured player and pitch his set should the injury occur whilst batting. Runners are not allowed.

(b) If a player can field but not pitch, the opposing captain elects another player to pitch his set.

(c) A team has until the end of the sixth set to allow late players to arrive and take part in the game.

3. OFFICIALS

The game is controlled by one (1) umpire, plus one (1) base-line umpire if available. The central umpire is located behind the pitcher in such a position as to be clearly able to see the strike zone. The line umpire is to be located behind second base on the rear wall in such a position to be clearly able to see 1st, 2nd and 3rd bases. Where possible, teams not involved in that game will be asked to provide the baseline umpire on a rostered basis. Where a remote controlled scoreboard is not used, the baseline umpire shall sit in a "Crow's Nest" and use the available scoreboard.

4. DURATION (a) A game consists of two innings, one per team. If the score of a game is tied, each team splits the match points for the game except in a Semi-Final or Grand Final where the game is re-played at a time convenient to both teams.

(b) Each of the first seven Pitchers will pitch ten (10) deliveries constituting a "set". Any wild pitches or no pitches must be re-pitched.

(c) The final pitcher must re-pitch any balls, no-pitches or wild pitches until seven (7) legitimate pitches (strikes or batted balls) have been made. A minimum of ten (10) pitches must be sent down in this set.

5. RULES OF PLAY

(i) Starting and Recommencing Play (a) The decision to bat or field is made by the toss of a coin. Players from the fielding side, take up their positions and the first batter takes his place in the batter's box. The game begins on the umpire's call of PLAY. All of the batting team must be inside the net of a bench provided.

(b) When the ball is put into play, all fielders except the catcher and pitcher may place themselves anywhere within fair territory. The pitcher takes up his position at either plate and the catcher crouches directly behind home plate.

(ii) Live and Dead Balls

The ball is live from the time it is pitched to the time the pitcher regains possession, excepting when it comes directly from the bat and until the runner/s make the proceeding base.

(iii) Fielding (a) A fielder tags a base when he touches that base with his body when holding the ball securely in his hand or glove. A fielder cannot tag a runner to put him out at *any base.*

(b) A fielder makes a catch in fair or foul territory when he gains secure possession of the ball in flight with his hand or glove provided he does not use any other part of his uniform to gain possession.

(c) A batter is *OUT* caught in foul territory if the ball is caught by the catcher after being struck above the batter's head and provided it has not hit a net. Any fielder may also catch a batter in foul territory provided it has not hit a net including the roof net.

(d) A batter may be caught off any net except any net in foul territory or the home run zone. No runners including the batter can be put out on a bonus home run.

(e) A fielder who is not in posssession of the ball and who is not attempting to field a batted or thrown ball may not impede the progress of any runner. *Notwithstanding* this, a fielder who is attempting to gain possession of the ball has right of way against a runner.

(f) A blocked ball is a thrown ball where a fielder is hindered fielding a ball, e.g. the ball going into batter's bench area. In this instance runners are only allowed to the next proceeding base. The ball is then DEAD.

(g) Where a batted ball is lodged in a net then the relevant bonus bases apply but the ball is DEAD thereafter.

(iv) Pitching (overarm or underarm)

(a) The ball must be held in two hands with at least one foot touching the pitching plate for one to ten (1–10) seconds. Once the throwing action has commenced, it must be completed.

(b) The rear foot must stay on the plate until the front foot is grounded.

(c) The umpire must call PLAY on every pitch to restart play. If a pitcher pitches before PLAY is called, it is a no-pitch.

(d) A male player must pitch from the underarm line to a female in a mixed game and cannot pitch at such a speed as to intimidate the batter. If he does, the delivery is a no-pitch and the pitcher can be dealt with under the Misconduct Rule.

(v) No-Pitch

A No-Pitch occurs if the pitcher pitches:

(a) During a suspension in play;

(b) Before the batter is in position;

(c) When the batter is still off balance after the previous pitch;

(d) When a runner is called out after leaving a base too soon;

(e) When a runner has not re-touched base after a foul ball;

(f) Where the ball hits the top net after being pitched and before the ball reaches the batter.

N.B. In all of the above cases, the ball must be re-pitched as if it did not happen.

(vi) Illegal Pitch

An Illegal Pitch occurs if:

(a) The pitching action is incorrect;

(b) The pitcher intentionally drops, rolls or bounces the ball to stop the batter striking it or fails to release the ball;

(c) The catcher is out of position when the pitch it released;

(d) The pitcher pitches without facing the batter.

N.B. In all of the above cases, the ball is DEAD, A BALL IS CREDITED and all runners advance one base without risk.

(vii) Wild Pitch

A Wild Pitch occurs where:

(a) A ball is pitched which is totally out of the reach of the batter;

(b) The ball bounces more than once before reaching the batter unless it is struck at.

N.B. In all the above cases the ball is DEAD and the lead runner is advanced one base without risk. If no-one is on base, the batter, provided he advances safely to 1st base, takes another base for each wild pitch pitched, after the ball becomes DEAD.

(c) Four (4) wild pitches to any one batter is walked home;

(d) No pitcher is able to pitch any more than fifteen (15) pitches (including wild pitches) in the first seven (7) sets.

(viii) Batting (a) Players must bat in the order in which they have been listed on the batting order. The batter must stand inside one of the batters' boxes to receive each pitch.

(b) The batter may choose to strike at a ball or not.

(c) The batter is out if a pitched ball is hit whilst more than half of one foot is outside the batter's box. The call is "Batting Out of the Box". *This only applies if the batter hits the ball.*

(d) When the batting team is short one or two batters, an OUT is called each time the missing batter/s would have come up to bat in the order. I is the batting captain's responsibility to advise the umpire each time in the order when this occurs.

(ix) Strike

A strike is called if a Legal Pitch occurs and:

(a) The pitcher is within the area over home plate between the batter's *KNEES and SHOULDERS* and he does not swing;

(b) The batter swings at any pitch and misses;

(c) The ball is hit into foul territory when the count is less than two (2) strikes. After two (2) strikes, only one (1) foul is allowed to go unpenalized, any foul thereafter is a strike;

(d) The ball touches the batter as he strikes at it;

(e) The ball touches the batter in flight in the strike zone;

(f) The ball is touched by the bat and goes directly less than head height and is legally caught by the catcher; "FOUL TIP".

(x) Ball

A ball occurs:

(a) Where the ball is pitched outside the strike zone, but within reach of the batter and is not swung at by the batter.

If the batter swings and strikes such a ball it is a batted ball. The batter completes time at bat when he becomes a runner or when he is put out.

(xi) Bonus Bases (Walks Without Risk)

(a) When the batter becomes a runner and successfully makes ground to first base, bonus bases may be scored if the ball strikes the net in fair territory at certain points as in the court layout. Whether in the air or on the ground, the bonus value is the same.

(b) Bonus bases are only given after the ball becomes DEAD.

(c) The value of the above can be one base, two bases, or home run. The effect is that the batter/runner advances without risk by the number of bonus bases scored. If in advancing without risk to a base, he would have passed another runner on base, that runner advances to the base in front of the batter/runner.

(d) In the case of a bonus home run, all runners on base and the batter/runner advance without risk to home base.

N.B. No bonus bases are scored where a ball hit into fair territory strikes a runner and then rebounds into a bonus net. If the contact is unintentional, the ball is still live, but if the runner has intentionally made contact with the ball he is put out.

(xii) Batter-Runner

The batter becomes a runner and advances to first or succeeding bases and runners advance as necessary on his action when:

(a) The ball is hit into fair territory;

(b) Where the catcher fails to catch the third strike and there is no runner on first base;

The batter gets a WALK (cannot be put out) and takes a walk to second base when;

(a) The pitcher has delivered four (4) balls, (b) The batter is interfered with by the catcher or another fielder, (c) A batter is hit by a pitched ball outside the strike zone and there is a likelihood of injury, provided he hasn't hit the ball and has attempted to avoid it. He will get at least a three (3) base walk. (The pitcher can be dealt with under the Misconduct Rule, i.e. Unduly Rough Play).

(xiii) Batter Put Out

A batter is put out when:

(a) A fielder makes a legal catch off a ball hit into fair territory directly or off a net, except a ball caught off the bonus Home Run Zone;

(b) A third strike is legally caught by the catcher, including a foul tip;

(c) A third strike is *not* legally caught by the catcher and the first base is occupied, (d) Attempts to hit a third strike and is touched by the ball, (e) He hits a fair ball twice or handles the ball.

(xiv) Running (a) A runner is entitled to an unoccupied base when he makes good his ground to the running line before he is put out except to home base where he must make good ground to the safety plate located in the right hander's batting box.

(b) When running to 2nd, 3rd and Home bases, there is a No Return Line two meters from the originating base.

(c) Tagging the runner in order to put him out is not allowed. He may remain on the base until put out or until required to vacate it by a preceding running crossing the No Return line to that base. If he does not vacate his base in this instance, the preceding runner can be put out at that base *AND* he may be put out at the base to which he is committed to advance.

(d) Once the runner has advanced over the No Return Line, he cannot return to the base, but is committed to continue to the next base running line.

(e) The only exception to this rule occurs where a runner is obliged to return to the base on a caught ball (See xvi, Runner Put-Out) before advancing to the next base.

(f) A runner, other than the batter/runner may advance one base without the possibility of being put out when:

(i) There is an illegal Pitch;

(ii) There is a wild pitch (Lead Runner only);

(iii) The batter's advance without liability to be put out, forces the runner to vacate his base.

(g) All runners including the Batter/Runner may advance without risk of being put out:

(i) To Home Base when a batted ball hits the Bonus Base Zone;

(ii) Two bases if a fielder deliberately throws any part of his uniform (including his glove) at a fair ball and so touches the ball;

(iii) *At least one base* if a fielder who is not in possession of the ball deliberately obstructs the progress of a runner.

(xv) Stealing

A runner on a base may advance at risk while the ball is in play after the ball is struck, passes the batter or if the pitcher drops it during the wind up.

(xvi) Runner Put Out

Runner is put out when:

(a) He interferes with a fielder attempting to field a batted ball or intentionally interferes with a thrown or batted ball;

(b) He fails to make good the running line before the ball is in possession of the next baseman making contact with the base;

(c) He passes a preceding runner before than runner is out;

(d) He leaves the base before the ball is struck or passes the batter;

(e) He fails to make good his ground back to his originating base on a caught ball before that base is tagged;

(f) The runner fails to touch each base in order when advancing or returning to base before the missed base is tagged.

(xvii) Team Scoring

During each team innings, everytime three outs are recorded one run is deducted from the team score of the batting.

(xviii) Misconduct Rule (a) There are certain rules of behaviour, the breach of which gives the umpire the power to penalize the offender and his team. No warning need precede the imposition of a penalty which will usually be in the order of one (1) base, multiples of that, or a batter and/or runner being put out.

(b) The following activities will attract the possibility of a warning or penalty, as above, at the umpire's discretion; swearing, abusing equipment, wasting time, arguing with the umpire and unduly rough play.

(c) The umpire shall also have the power to remove a player from the field, should be consider that the player's action is of sufficient seriousness. Management will then have the right to impose further penalties. If a player is removed from the field in these circumstances, he cannot be replaced.

(d) The umpire or management will also have the power to stop the game and award it to either team if the misconduct has gone beyond the point of being controllable.

(e) The Misconduct Rule relating to unduly rough play will be invoked where any batter strikes the ball so hard as to physically endanger anyone pitching from the underarm line.

6. LEAGUE SCORING SYSTEM

Points are awarded as follows:

6 points for a win;

3 points for a tie;

1 point for each 5 runs scored;

1 point for each 5 runs by which you defeat the opposition;

1 point for all players being in uniformed shirts;

Average points for the Round for a team who wins on forfeit.

7. QUALIFICATIONS (a) A player must play at least four (4) games with a team before being eligible to play with that team in the finals. However, in the opinion of the management it can be shown that, due to the unforseeable circumstances, they are unable to field a full team, players who have played at least two (2) games with that team, may be eligible to play in the finals. If so, they shall incur a penalty of one (1) run each for each game by which they fail to qualify.

(b) Players may not play with two (2) teams in the same grade on the same night. However, if a team is short, another player may fill in with the approval of the opposite captain.

8. MIXED, JUNIORS AND WOMEN

Individual centres may make house rules relating to conduct of other different competitions.

The claims form part of the specification.

The claims defining the invention are as follows:

1. An indoor baseball apparatus comprising a playing enclosure including a playing surface surrounded by perimeter walls, a roof overlying said walls, said walls being transparent to the extent enabling a game played within said enclosure to be viewed from outside said enclosure, a miniature baseball diamond on said playing surface and including a defined base at each apex of said diamond, a short line called a running line marked on said surface at a point between each of said bases except between third base and home base, each said running line traversing a line extending between each said base and being a substantial distance towards the proceeding base in the direction of movement of a runner, a defined "home run" zone on a said wall of said enclosure, which wall is behind second base when viewed from home base, and alternate pitching plates on said surface within said diamond and in alignment between home base and second base at respective distances from home base.

2. An apparatus as defined in claim 1 wherein said home run zone is defined by a horizontal line marked on said wall, said horizontal line being 2 meters above said surface and 10 meters long and being centrally positioned along the length of said wall, and respective vertical lines extending between the ends of said horizontal line and said roof.

3. An apparatus as defined in claim 2, wherein said running lines are positioned a distance substantially 11.5 meters from the preceding base in the direction of movement of a runner.

4. An apparatus as defined in claim 3, wherein a "no return" line is marked on said diamond proceeding 1st, 2nd and 3rd base and a distance substantially 2 meters from the preceding base.

5. An apparatus as defined in claim 4, wherein said playing enclosure in rectangular having side walls which are in the range 28–30 meters long and 4.5 meters high and end walls in the range 20–24 meters long and 4.5 meters high, said home run zone being on a said end wall.

6. An apparatus as defined in claim 5, wherein home base is positioned 3 meters from a said end wall, first and third bases are positioned 2 meters from a respective said side wall and second base is positioned 4 meters from the other said end wall, the line of said diamond joining third base and home base being at 90° to the line joining home base and first base.

7. An apparatus as defined in claim 6, wherein one of said pitching plates is arranged 14 meters from home base and the other of said pitching plates is arranged 17 meters from said home base.

* * * * *